US009260799B1

(12) United States Patent
Tao

(10) Patent No.: US 9,260,799 B1
(45) Date of Patent: Feb. 16, 2016

(54) MELT-BLOWING APPARATUS WITH IMPROVED PRIMARY AIR DELIVERY SYSTEM

(71) Applicant: Thomas M. Tao, Greer, SC (US)

(72) Inventor: Thomas M. Tao, Greer, SC (US)

( * ) Notice: Subject to any disclaimer, the term of this patent is extended or adjusted under 35 U.S.C. 154(b) by 1 day.

(21) Appl. No.: 14/167,631

(22) Filed: Jan. 29, 2014

Related U.S. Application Data

(60) Provisional application No. 61/854,975, filed on May 7, 2013.

(51) Int. Cl.
*D01D 5/098* (2006.01)
*D01D 4/02* (2006.01)
*D04H 3/16* (2006.01)

(52) U.S. Cl.
CPC . *D01D 4/025* (2013.01); *D04H 3/16* (2013.01)

(58) Field of Classification Search
None
See application file for complete search history.

(56) References Cited

U.S. PATENT DOCUMENTS

| | | | | |
|---|---|---|---|---|
| 3,825,380 | A | 7/1974 | Harding et al. | |
| 3,849,241 | A | 11/1974 | Butin et al. | |
| 4,112,159 | A | 9/1978 | Pall | |
| 4,285,655 | A | 8/1981 | Matsubara | |
| 4,486,161 | A | 12/1984 | Middleton | |
| 4,526,733 | A | 7/1985 | Lau | |
| 4,818,463 | A * | 4/1989 | Buehning | 264/40.1 |
| 4,889,476 | A | 12/1989 | Buehning | |
| 4,986,743 | A | 1/1991 | Buehning | |
| 5,080,569 | A | 1/1992 | Gubernick et al. | |
| 5,248,247 | A * | 9/1993 | Rubhausen et al. | 425/66 |
| 5,580,581 | A | 12/1996 | Buehning | |
| 5,632,938 | A | 5/1997 | Buehning, Sr. | |
| 6,182,732 | B1 | 2/2001 | Allen | |
| 6,336,801 | B1 * | 1/2002 | Fish et al. | 425/7 |
| 6,427,745 | B1 | 8/2002 | Allen | |
| 6,972,104 | B2 * | 12/2005 | Haynes et al. | 264/211.14 |
| 2002/0053390 | A1 * | 5/2002 | Allen | 156/167 |

OTHER PUBLICATIONS

E.K. McNally, "Melt Blown Nonwovens with Increased Basis Weight Uniformity and Reduced Power Consumption", TAPPI Nonwovens Conference Proceedings, Apr. 1993, pp. 125-128.

Richard Slack, "Melt Spinning of Sustainable Polymers", International Fiber Journal, Dec. 2011, pp. 32-33.

Correspondence from Wellman Thermal Systems, Inc., Shelbyvile, IN, including electric air heater specifications and data, dated Jun. 21, 1994.

"Table A 2a, Properties of air elevated temperatures (American units)", North American Combustion Handbook, Jan. 1978, p. 344, Second Edition, North American Manufacturing Co., Cleveland, OH.

* cited by examiner

*Primary Examiner* — Monica Huson
(74) *Attorney, Agent, or Firm* — Charlotte C. Wilson

(57) ABSTRACT

An improved melt-blowing apparatus includes a primary air system with a plurality of air tubes and a die tip assembly having a die tip and a pair of oppositely disposed air plates. A flow-splitting device efficiently divides a stream of pressurized and heated primary air into multiple tubular flows, which are fed into air intake passages in the die tip assembly. The flow-splitting device and the air tubes are located radially outward and independent of the die body and the die tip assembly. The tubular air flows are transformed into two uniform air knives by a distribution chamber within the die tip assembly. The present primary air supply system simplifies the equipment, saves energy, improves product quality, and reduces operational and maintenance efforts.

10 Claims, 9 Drawing Sheets

1
MD
CD
HT
6
7
30
4
3
5
2
20
22
AIR

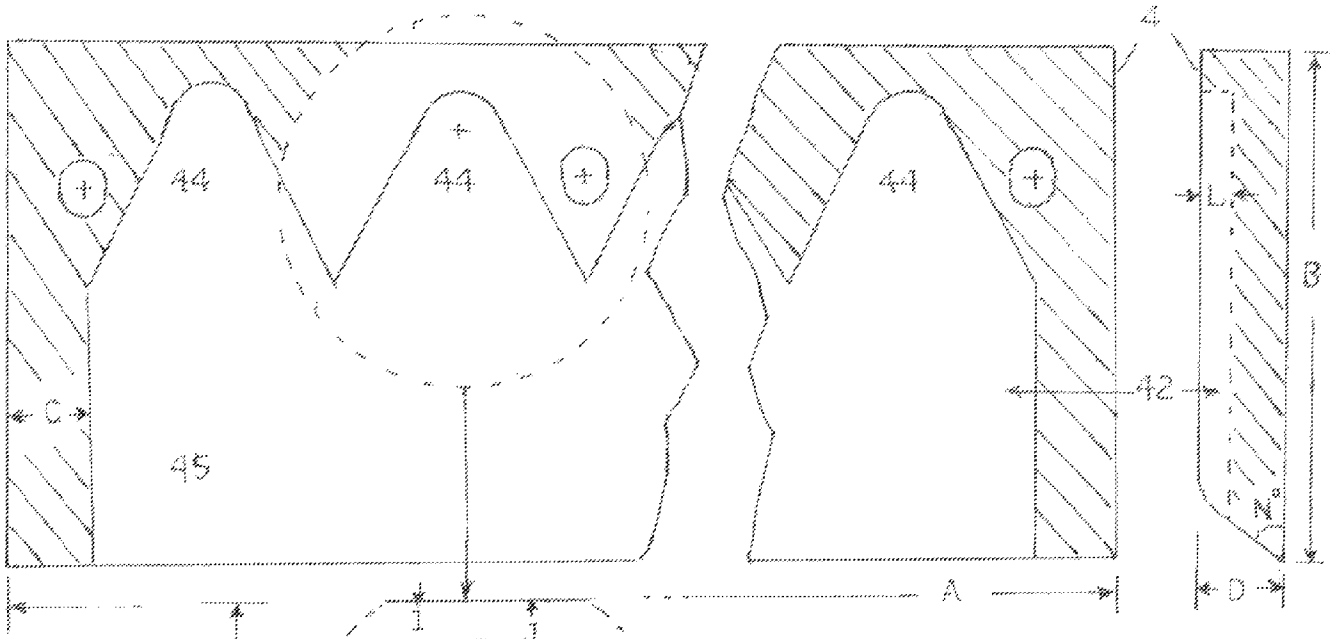
FIG. 4
FIG. 5
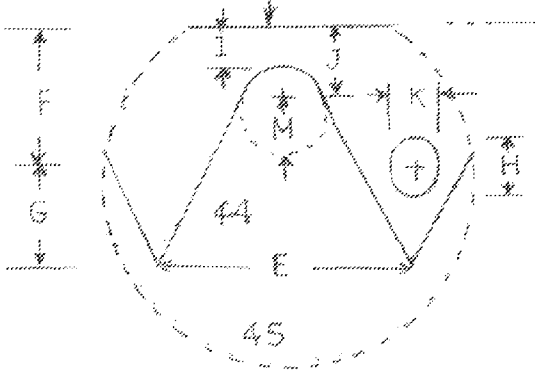
FIG. 6

11
10
6
8
AIR 10
6
8

MELT-BLOWING APPARATUS WITH IMPROVED PRIMARY AIR DELIVERY SYSTEM

CROSS-REFERENCE TO RELATED APPLICATIONS

The present application is a non-provisional application, claiming priority to U.S. Provisional Application No. 61/854,975, filed May 7, 2013.

TECHNICAL FIELD

The present invention relates to the formation of nonwoven webs and, particularly, to the formation of nonwoven webs of thermoplastic filaments by blow-extrusion techniques. More particularly, this disclosure is directed to improvements to a method and apparatus for manufacturing nonwovens by a process commonly known as "melt blowing."

BACKGROUND

Nonwoven substrates (also called simply "nonwovens") are webs and or three-dimensional structures of individual fibers or threads, which are interlaid but not in an identifiable manner typical of a knitted or woven substrate. Historically, nonwovens have been made by one of several different processes, such as melt blowing, spunbonding, air-laying, wet-laying, co-forming, carding, needle punching, spunlacing, and the like. The base weight of nonwovens is expressed in ounces per square yard (osy) or grams per square meter (gsm), and the fiber diameters may be measured in deniers, microns, or nanometers (ranging in size from highest to lowest). The term "mat" may be used interchangeably with the term "web" to refer to a nonwoven substrate.

Melt blowing is a major manufacturing technology for producing fibers for nonwoven webs. The term "melt blown" refers to fibers or a mat formed by extruding a molten thermoplastic material (the "melt" or the "polymer melt") through a plurality of fine orifices as molten filaments into converging flows of high-speed heated gas in a process described more fully herein.

Melt blown webs are produced by extrusion of a polymer melt, as mentioned above. The term "polymer" includes homopolymers, copolymers (such as, for example, block, graft, random and alternating copolymers), terpolymers, and blends and modifications thereof. Furthermore, the term "polymer" shall include all possible geometric configurations of the molecule. These configurations include molecules with isotactic and random symmetries.

Nonwoven webs produced by melt blowing are used in a wide variety of applications, ranging from aerospace to medical to industrial uses, where an integral protective substrate is desired or required. One exemplary product made by nonwovens is filter media.

The manufacture of nonwoven webs by melt blowing has been described in U.S. Pat. No. 3,825,380; U.S. Pat. No. 3,849,241; and U.S. Pat. No. 4,889,476, for example, as well as in numerous other publications. Generally speaking and without reference to any specific patent or other publication, the polymer is melted in an extruder and forced through a row of fine capillaries (known as "orifices" or "nozzles") to produce molten filaments. The orifices are defined through the apex of a sharp angled metal structure called the "die tip." The die tip is surrounded by two adjacent parts known as "air plates" or "air knife plates" that define a gap between the plates and the die tip that constitutes the geometry of the "air knives." Together, the die tip, the orifices, and the air plates are referred to as the "die tip assembly."

High pressure, high temperature air (the "primary air") passes through the gap between the air plates and the die tip to form the air knives. The pressure of the supplied primary air determines the blowing speed of the air knives. The air knives attenuate the molten filaments as they exit the orifices to reduce their diameters and to improve the molecular alignment of the polymer. By regulating the temperature and pressure of the primary air and polymer melt, this arrangement is capable of producing fibers of different diameter sizes, from the large micron to the sub-micron diameter range.

Specifically, the melt blowing process can be used to make fibers of various diameters, including macro fibers (average diameters from 40 to 100 microns), textile-type fibers (10 to 40 microns), microfibers (1 to 10 microns), ultra-fine microfibers (under 3 microns), submicron fibers (less than 1 micron) and nano-fibers (0.2 to 0.7 microns). Melt blown fibers may be continuous or discontinuous, and are often self-bonding when deposited onto a collecting surface.

After the molten polymer passes through the die tip orifices and is contacted by the air knives, the air-borne molten filaments begin to solidify and are cooled by unheated or cooled ambient air (referred to herein as the "cooling air" or the "secondary air") in a step known as "quenching." In addition to cooling the polymer, quenching also impacts the molecular properties of the fibers, such as crystallization. The fibers are then randomly deposited onto a collector's moving porous surface, such as a rotating drum or a conveyor belt—often assisted with suction beneath the drum or belt surface—to form a nonwoven web, mat or article with significant integrity resulting from a high degree of fiber entanglement and bond.

For making products of considerable width, a device called a "die" (or "die body") can be used to spread the hot melt flow coming from the extruder into a uniform slit flow of desired width, which is suitable to be fed into the die tip. The most advanced die type is the "coat hanger die," as described in U.S. Pat. No. 4,285,655. Other types of die bodies currently in use include a linearly tapered die, a slot die, a T-shaped die, a fishtail die, and the like.

Because of its ability to produce micro-fibers useful in a large variety of products, melt blowing technology enjoys continued popularity in industry. However, many significant shortcomings remain, many of which are documented below:

A. Melt blowing is energy intensive. Large amounts of energy are required for pressurizing, heating, and distributing the primary air streams. Mainly as a result of the design of existing melt blowing equipment, the primary air must be heated to temperatures near that of the polymer melt flow. The temperatures of the polymer melt flow in the die and the primary air must have a minimal differential in order to maintain the thermal equilibrium and homogeneous viscosity of the polymer melt. Producing a large volume of high temperature air (that is, the primary air flow) is expensive and leads to troublesome manufacturing consequences.

One consequence is that the secondary air used to quench the newly extruded fibers must be sufficiently cool and of sufficiently large volume to offset the heat of the primary air in order to effectively quench and solidify the fibers. If the secondary air is not sufficiently cool or of a sufficiently large volume, the resulting web has a harsh texture with embedded shots. "Shots" are small beads of re-melted fibers and/or polymer melt that failed to be attenuated into discrete fibers. In addition to affecting the texture of the web, shots cause the web to have poor appearance, opacity, coverage, strength, and filtration efficiency.

Another problem is that slow solidification and over-attenuation by the hot primary air may turn some fibers into "flies." Flies are tiny broken fibrous bits and pieces that escape the main fiber stream. Flies contaminate the product and the equipment, as well as causing a hazardous work environment.

Also, the consumed primary air supply undesirably heats up the manufacturing environment. As a result, it is often necessary to prepare and supply additional secondary cooling air. Ventilation, air conditioning, and air balancing means may be required during hot hours and hot days. Such additional cooling means can be costly and cumbersome.

U.S. Pat. No. 4,112,159 acknowledges some of the benefits of having cooler primary air but did not disclose a way to achieve it. U.S. Pat. No. 4,526,733 suggests using insulation between the die tip apex and the adjacent airflow for the said benefits. U.S. Pat. No. 6,336,801 suggests special heater devices and insulation to be installed on or inside the die tip apex to allow for cooler primary air flows. None of these methods has been widely accepted, because the die tip apex is only a small part of the many surface areas where thermal interference may occur and because the methods proposed are complicated and costly. Additional operation and maintenance incurred may be burdensome. More effective and simpler means to thermally separate the primary air flow and the melt flow are still needed.

B. Each polymer type has its own unique quench requirement for molecular crystallization soon after molten filaments are formed through the orifices. Meeting this requirement is important to fiber formation and its final quality. With some polymers, the necessary temperature differential between the molten filaments and the quenching air is so large that most conventional melt blowing equipment cannot maintain the requisite temperature differential. As a result, many polymer types are unsuitable for use in the currently available melt blowing equipment.

By way of example, newly developed bio-based polymers (made from organic materials or biomass) are of particular interest in medical applications, where the fiber polymer may be compounded with medicine. The resulting nonwoven web may be applied to or below the skin of a patient, such that the fibers and medicine may be dissolved and absorbed by the patient's body at a desired and controlled rate. This delivery mechanism results in a valuable medical device.

To date, the difficulty in producing this type of medical device is that the bio-based polymers have a low crystallization rate that requires a relatively large temperature differential for quenching. Since the present melt blowing equipment is unable to allow for the needed temperature differential between the primary air flow and the polymer melt flow, bio-based nonwoven substrates are expensive to produce and are available only in limited supply.

C. Conventional melt blowing equipment has low production capabilities with rigid ceilings because there are intrinsic limitations in both their melt and blowing systems. Specifically, the fine orifices at the apex of a die tip that issue molten filaments have limited structural strength to withstand melt pressure. Excessive pressure will crack the metal and allow the melt to ooze out in an uncontrolled manner. Die tip cracking is a messy and costly accident known by people in the industry as an "un-zipper." There have been many efforts to reduce this risk. For example, U.S. Pat. No. 3,825,370 teaches the use of hypodermic tubings in place of drilled orifices; U.S. Pat. No. 4,486,161 teaches the use of tie bars to reinforce the die tip; and U.S. Pat. No. 4,986,743 teaches the use of a pre-stress method to do the same. Only moderate improvement was achieved.

The conventional "blowing" system also cannot tolerate additional primary air flow because it employs the so-called "manifold" technique repeatedly (as shown in FIG. 1) to convert the primary air into air knives of usable uniformity. This technique, also known as the "reservoir" or "dissipation" method, uses sudden expansion and restriction of the flow's cross-sectional area and/or abrupt turns to reduce the momentum of the air flow in exchange for flow uniformity in the width direction (CD). The restriction and/or turning of the air flow results in a large loss of kinetic energy. When airflow exceeds the designed volume, energy consumption rises steeply, and flow uniformity deteriorates.

Good air uniformity is harder to achieve on a wide apparatus because large manifolds and pipes naturally have large Reynolds numbers, which means erratic secondary flows will co-exist with the main flow. Also, the increased width of the apparatus makes the machine bulky and clumsy in all three dimensions. U.S. Pat. No. 5,080,569 provides an effort to hold down the size for wide machines. It employs a specially configured pressure control diverter built inside the manifold and additional control dampers installed outside downstream of the manifold to manipulate the uniformity of the flow. However, in industrial practices, the benefit gained is offset by the added complexity in equipment and operation.

D. In some instances, it is desirable to produce a composite nonwoven from multiple web forming processes simultaneously. For example, it is common for spun-bonded and melt blown nonwovens to be generated in tandem to form a composite nonwoven substrate having one or more layers of each type of nonwoven. Due to the limited production capability of a conventional melt blowing apparatus, multiple units used in tandem may be used in situations only when their combined production rate can keep pace with that of the co-working process. Such examples include SMMS and SMMMS processes, where "S" stands for a spunbonding apparatus and "M" for a melt blowing apparatus. But using too many melt blowing units in tandem is costly and cumbersome. Therefore, melt blowing units capable of higher production are desirable.

In addition to higher production capability, the multi-process users also want melt blowing apparatuses to have a smaller dimension in the machine direction, preferably less than 1 meter. The present norm is 1.5 to 5 meters, depending on machine's width. The reduced machine direction dimensions occupy less factory space or permit a more generous secondary air flow system (quench air) that is beneficial to process and product quality. U.S. Pat. No. 6,972,104 presents a design for a melt blowing apparatus having reduced machine direction dimension, but requires a complicated and costly internal structure.

E. The fine orifices on the die tip get contaminated gradually by impurities and gel in the melt flow during use. This die tip contamination leads to a progressive decline of process efficiency and product quality. Scheduled and unscheduled replacements of the die tip assembly must be performed. Replacing the die tip requires first shutting down and cooling-off the entire melt blowing apparatus, followed by disassembling, replacing, reassembling, and adjusting the die tip; reheating the die body and the primary air flow; restarting and readjusting the melt blowing apparatus; and finally zeroing in on the product specifications. These many steps waste a significant amount of labor, material, and time.

A method for improvement is described in U.S. Pat. No. 5,580,581 and U.S. Pat. No. 5,632,938, in which a special die tip assembly is designed to avoid disassembly and re-assembly works on the main die body. This die tip assembly may be installed onto, and replaced from, the die body without the aforementioned cooling off and reheating steps. However, this design involves extra parts and weight, cannot allow on-line adjustment of air gap, and does not address other issues discussed in this section.

F. Air gap setting and its evenness impact product quality directly. Therefore, it is desirable to periodically check the air gap setting and to make on-line corrections, if necessary, to reduce product defects and waste. U.S. Pat. No. 4,889,476; U.S. Pat. No. 5,080,569; and U.S. Pat. No. 5,248,247 allow for such gap setting and adjustment. Unfortunately, each of the prior art approaches requires shutting down and cooling off the entire machine to replace the die tip assembly. Thus, a design that can provide both benefits (E and F) is desired.

G. Due to the common presence of fibrous "flies," the melt blowing apparatus and its surroundings need diligent and regular clean-up to avoid problems with safety, health, and product quality. To minimize flies and to facilitate cleaning, it is desirable to have an apparatus with a simpler configuration and a smaller size.

H. It is slow and expensive to build a new melt blowing apparatus. To rebuild an existing primary air system for any reason is also difficult and costly, because the air flow pathway built inside the die body and the die tip assembly is tortuous.

A more cost-effective and efficient design is desirable. Also wanted is a design that can properly process a wider range of polymer types. These improvements are likely to increase the nonwoven manufacturers' profit.

It is therefore an objective of the present invention to provide improved equipment design for the production of melt blown nonwovens. Specific goals include energy savings, simpler equipment, easier operation and maintenance, better product uniformity and quality, broader raw material choices, and smaller apparatus size.

SUMMARY

The present disclosure is directed to a melt blowing apparatus and an improved primary air flow delivery system for the apparatus. The apparatus includes a die body for receiving a molten polymer stream from an extruder, where the die body defines a channel therethrough. A die tip assembly is provided downstream of the die body and includes a die tip having a die tip apex in fluid communication with the channel in the die body and further having air intake passages defined therethrough. The die tip assembly also includes a pair of oppositely disposed air plates located radially outward of the die tip apex and axially downstream of the die tip to define a gap between the die tip and the air plates. Primary air tubes are arranged in oppositely disposed sets, which are located radially outward of the die body. Each of the tubes is configured to convey a pressurized gas stream through the air intake passages of the die tip and into the gap adjacent the air plates to produce air knives. A collector surface is disposed opposite the die tip apex at a die-to-collector distance, such that the molten polymer stream passing through the die tip apex is attenuated by the air knives to form melt blown filaments that fall as fibers on the collector surface to produce the melt blown nonwoven substrate.

A method of producing a melt blown nonwoven substrate begins with directing a molten polymer stream from an extruder through a die body defining a channel therethrough. The method further includes providing a die tip assembly downstream of the die body, in which the die tip assembly includes (i) a die tip having a die tip apex in fluid communication with the channel in the die body and further having air intake passages defined therethrough; and (ii) a pair of oppositely disposed air plates located radially outward of the die tip apex and axially downstream of the die tip to define a gap between the die tip and the air plates. The method includes: directing the molten polymer through the die tip outlets to produce a multiplicity of filaments; directing pressurized gas through a plurality of air tubes arranged in oppositely disposed sets to produce air knives; contacting the filaments with the air knives to attenuate the filaments into fibers; and collecting the fibers on a collector surface disposed opposite the die tip apex to form a melt blown nonwoven substrate. As above, each of the primary air tubes directs pressurized air streams through the air intake passages of the die tip and into the gap adjacent the air plates to produce the air knives.

Devices for efficiently splitting the air flow into the primary air supply tubes and for securing the primary air supply tubes in a bundle for easier connection to the die tip are also provided herein.

The present melt blowing apparatus with its die tip assembly and primary air handling system is significantly simpler and less expensive than conventional melt blowing equipment, while still resulting in highly uniform air knives, significantly lower energy requirements, and higher quality product. Many other operational advantages are also made possible, including the ability to replace die tip assembly without lengthy stops of the production line.

BRIEF DESCRIPTION OF THE DRAWINGS

A full and enabling disclosure of the present products and methods, including the best mode thereof, directed to one of ordinary skill in the art, is set forth in the specification, which makes reference to the appended figures, in which:

FIG. 4 is a cross-sectional view of the inside surface of an air plate, according to the present disclosure;

FIG. 5 is a side cross-sectional view of the air plate of FIG. 4;

FIG. 6 is an enlarged view of a portion of air plate of FIG. 4;

Figure 1:
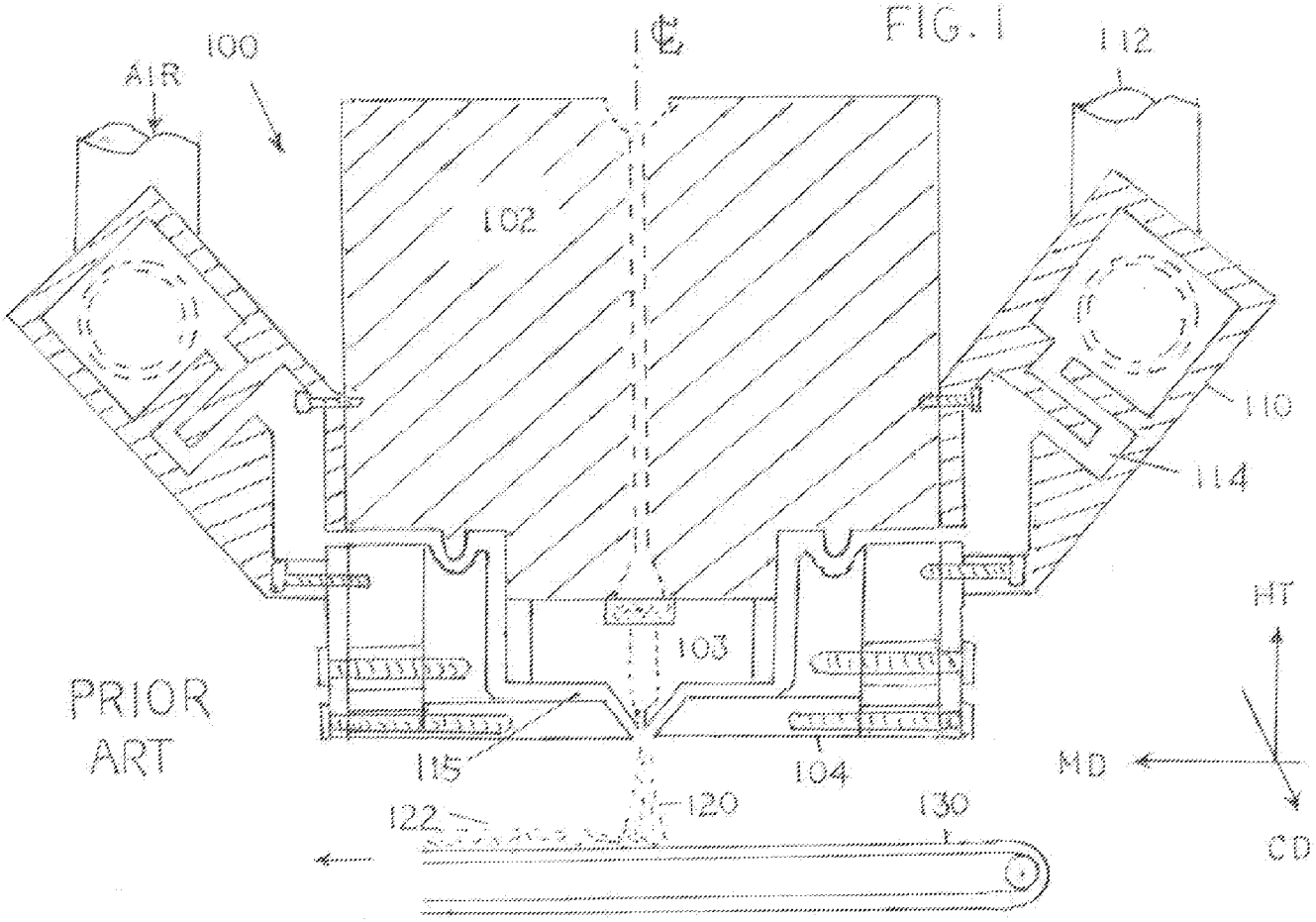
FIG. 1 PRIOR ART
FIG. 1 is a side cross-sectional view of a typical melt blowing apparatus of the prior art.

The drawings incorporate the following reference numbers, the descriptions of which are provided in TABLE 1 below for the aid of the reader.

In each instance, the term "air" is used generically to describe any gaseous fluid that may be pressurized and used in the melt-blowing apparatus taught herein, including air, inert gases, and combinations thereof. The terms "air" and "gas" may be used interchangeably, unless a specific composition is otherwise recited in the claims.

TABLE 1

| Element List | |
|---|---|
| 1 | melt-blowing apparatus |
| 2 | die body or die |
| 3 | die tip |
| 4 | air plates or air knife plates |
| 5 | die body channel |
| 6 | tube organizer |
| 7 | die tip assembly |
| 8 | primary air conduit |
| 9 | primary air supply tubes |
| 10 | flow splitting device |
| 11 | flow damper |
| 20 | melt blown fibers |
| 22 | melt blown nonwoven substrate |
| 24 | steel bars |
| 25 | fasteners |
| 26 | hinge socket |
| 30 | collector surface |
| 31 | breaker bar |
| 32 | melt flow chamber |
| 33 | die tip outlet or office |
| 34 | air intake passage |
| 35 | die tip apex |
| 36 | die tip front surface |
| 37 | die tip end brackets |
| 38 | push screws for air plate |
| 39 | pull screws for air plate |
| 40 | air flow gap |
| 41 | fastener for air plate |
| 42 | air flow distribution chamber |
| 44 | air flow distribution sub-chamber |
| 45 | air flow distribution tranquilizing chamber |
| 48 | air plate back surface |
| 47 | air plate front surface |
| 48 | radial flow regulating vanes |
| 49 | axial flow regulating vanes |
| 61 | tube organizer bar |
| 62 | tube holding mechanism |
| 63 | locking handle |
| 64 | handle spring |
| 65 | anchor |
| 66 | spring plate |
| 67 | latching lock |
| 68 | guide bar |
| 69 | end bracket slot |
| 100 | prior art melt blowing apparatus |
| 102 | die body |
| 103 | die tip |
| 104 | air plate |
| 110 | primary air manifold |
| 112 | primary air pipe |
| 114 | primary air flow path through manifold |
| 115 | primary air flow path through manifold |
| 120 | melt blown fibers |
| 122 | melt blown nonwoven substrate |
| 130 | collector surface |

DETAILED DESCRIPTION

Reference will now be made in detail to embodiments of the inventive products and methods, one or more examples of which are illustrated in the drawings. Each example is provided by way of explanation of the invention, not limitation of the invention. In fact, it will be apparent to one of ordinary skill in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as fall within the scope of the appended claims and their equivalents.

FIG. 1 illustrates a melt blowing apparatus 100, according to the conventional design. The product flow direction (MD, also known as machine direction), transverse direction (CD, a.k.a. cross direction) and the apparatus height direction (HT) are indicated in a legend. The term "machine direction" refers to the direction of travel of the formed web, whereas "cross direction" is the horizontal direction that is perpendicular to the machine direction. The "height" (HT) direction is a direction that is perpendicular to both machine direction and cross direction.

The apparatus 100 includes a centrally located die body 102, a die tip 103, air plates 104, and a plurality of primary air manifolds 110 that are supplied by primary air conduits 112. The primary air manifolds 110 are connected to the die body 102 by removable and adjustable fasteners, such as bolts. The air flow paths 114 through the air manifolds 110 and the air flow paths 115 between the die body 102 and the air plates 104 are tortuous and restricting. Because the tortuous paths 114, 115 cause significant pressure loss to the air flow that becomes the air knives, the primary air flow must necessarily have a high starting pressure.

Moreover, if the temperature of the primary air is significantly different from that of the die body 102 and the die tip 103, thermal interference may occur. Thermal interference hurts uniformity of both melt temperature and viscosity, while the polymer melt is inside the die and die tip, as melt viscosity sensitively depends on the melt temperature. In short, the heat transfer between the primary air flow and the die body and the die tip must be minimized to protect the performance of the die body and, therefore, the quality of the melt blown product. Conventionally, the polymer melt temperature and the temperature of the die body are maintained as closely to one another as possible.

The fibers 120 produced by the die tip 103 are quenched by ambient or cooled air (not shown) and are allowed to fall onto a porous collector surface, such as conveyor belt 130, where the fibers 120 adhere to, or are entangled with, one another in random orientation to form a nonwoven substrate 122. If desired, a vacuum may be pulled on the underside of the conveyor belt 130 to promote web formation.

Building the structure shown in FIG. 1 is both expensive and difficult, especially for equipment of great width. As the width (CD) of the device 100 increases, the manifolds 110 and air paths 114 also must have enlarged sizes in the machine direction, cross-machine direction, and apparatus height.

Figure 2:
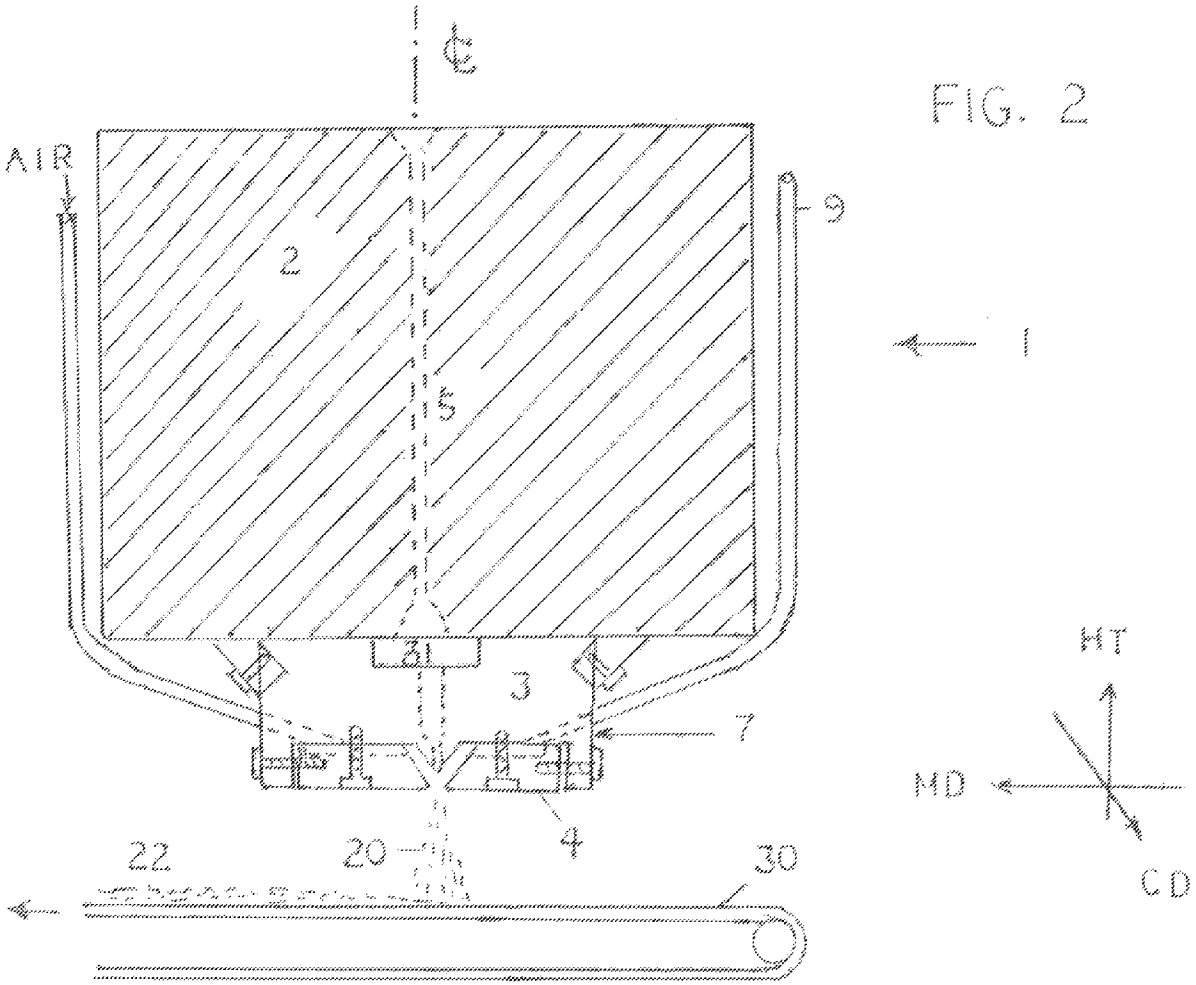
FIG. 2 is the side cross-sectional view of a melt blowing apparatus, including a die body and die tip assembly, according to the present disclosure.

FIG. 2 shows a melt blowing apparatus 1, according to the present disclosure. The melt blowing apparatus 1 includes a die body 2, a die tip assembly 3 including air plates 4, and a plurality of primary air tubes 9. The die body 2 receives the melt flow from the upstream equipment, such as an extruder and metering pumps (not shown). The die body 2 defines a channel 5 therethrough, which converts the polymer melt into a reasonably uniform slit flow of desired width. There are uniformity requirements for each part of the melt flow, including the uniformity of the melt flow rate, the polymer melt temperature, the residence time within the die body 2, and the shear history of each part of the melt flow. Maintaining these uniformity requirements is a complex and critical task performed by the die body, and such task increases in difficulty with the width of the apparatus.

The most commonly used die body type for wide melt blowing apparatuses is the so-called "coat hanger die," as fully described in U.S. Pat. No. 4,285,655 to Matsubara. For narrow melt blowing apparatuses or for applications with less stringent uniformity requirements, other simpler types of dies may suffice. Typically, a die body 2 is made of two mirror-image halves of rectangular metal blocks, which are assembled together but which are detachable for maintenance. Each half has a massive body and multiple heaters (not shown) to assure thermal uniformity and stability for the melt flow. Since the melt blowing apparatus 1 is made of two mirror-image halves along its centerline, the features and functions of one half are equally applicable to the other half.

Figure 3:
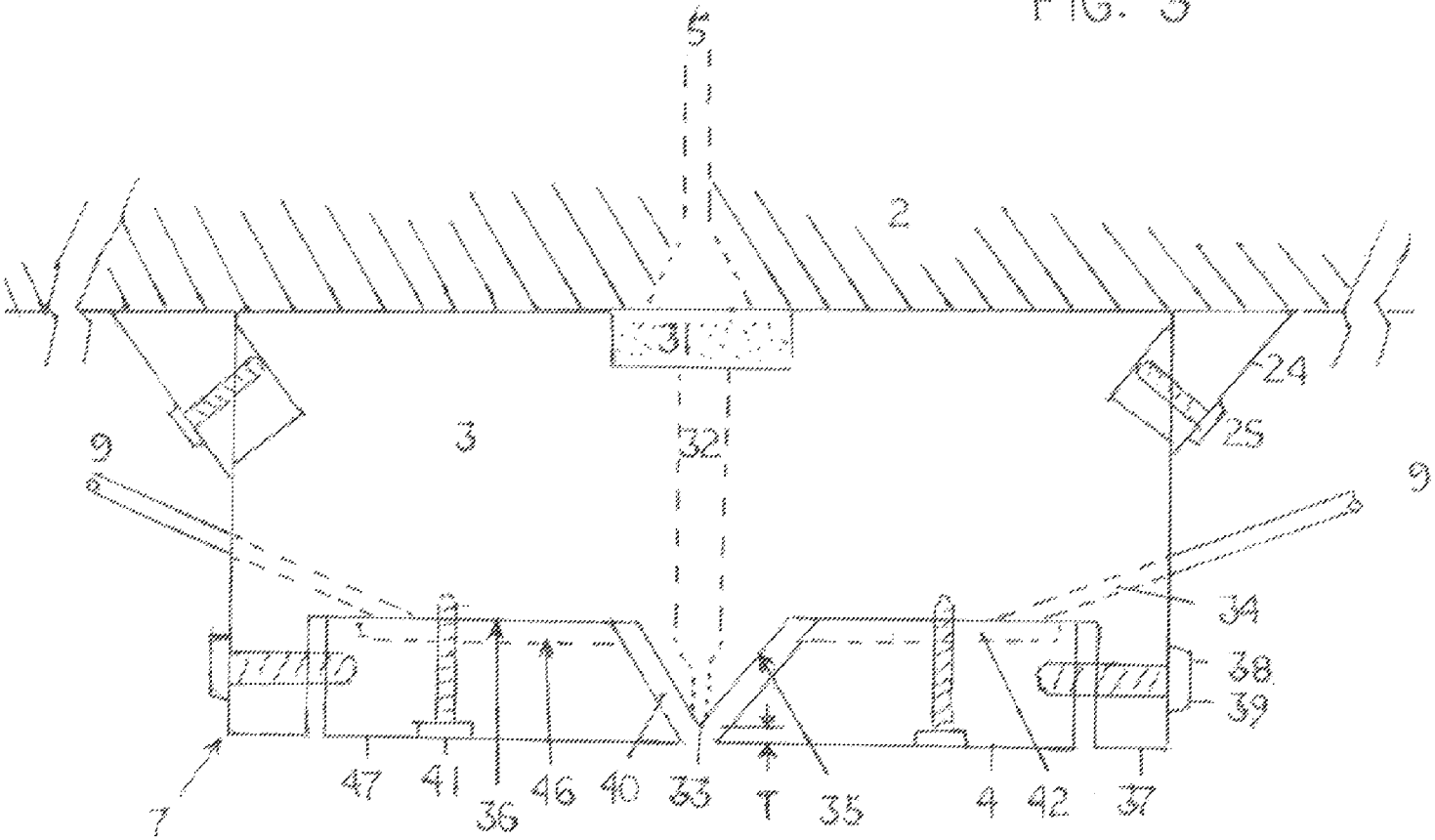
FIG. 3 is a close-up side cross-sectional view of the die tip assembly of FIG. 2.

The die tip assembly 7 includes a die tip 3 having a melt flow chamber (32, as shown in FIG. 3) therein. The melt flow chamber 32 is axially aligned with, and downstream of, the channel 5 in the die body 2. At the distal end of the die tip 3 (relative to the die body 2), the die tip 3 forms an apex (35) defining a linear row of fine orifices, or outlets, (33) in fluid communication with the melt flow chamber 32.

The primary air tubes 9 are arranged in oppositely disposed sets, each set being located radially outward and independent of the die body 2. Each of the primary air tubes 9 is configured to convey a pressurized air stream through air intake passages 34 on the die tip 3. The air streams flow through the air intake passages 34 and are directed toward the molten polymer stream by a pair of oppositely disposed air plates 4 (also known as "air knife plates"). The air plates 4, which are located axially downstream and proximate the die tip 3 and axially downstream of the die body 2, are adjustably mounted to the die tip by fasteners, such as screws 38, 39, and 41, as will be discussed further herein.

As shown in FIG. 2 and with greater detail in FIG. 3, the molten polymer stream travels under pressure through the channel 5 in the die body 2, through the melt flow chamber 32 in the die tip assembly 7, and through the outlets 33 in the apex 35 of the die tip 3 to form molten filaments, that become fibers 20. FIG. 2 illustrates the fibers 20 being collected on a collector surface, such as a conveyor belt 30, where the fibers 20 collect to form a nonwoven substrate 22. As mentioned previously, the collector surface 30 may be porous, such that a vacuum may be pulled on the collector surface to promote formation of the nonwoven substrate 22. The distance between the apex 35 of the die tip 3 and the collector surface 30 is defined as the die-to-collector distance. Adjustments to the die-to-collector distance and/or to the speed of the conveyor belt 30 may be used to alter the thickness and/or base weight of the resulting nonwoven substrate 22.

Turning specifically to FIG. 3, steel bars 24 are attached to the downstream surface of the die body 2. The steel bars 24 are configured to facilitate mounting of the die tip assembly 7 to the die body 2. When tightened, the fasteners 25 positioned through the steel bars 24 secure the die tip assembly 7 firmly against the downstream surface of the die body 2. By way of example, the fasteners 25 may be screws or other threaded fasteners that are readily removable to disconnect the die tip assembly 7 from the die body 2.

As described, the die tip 3 defines a centrally located melt flow chamber 32 therethrough, which is in fluid communication with the channel 5 in the die body 2. At the upstream end of the die tip 3 (that is, proximate the die body 2), the die tip 3 includes a "breaker bar" 31, which is a porous filtering device that prevents solid and jelly-like impurities in the melt flow from entering the die tip 3. The apex 35 of the die tip 3 typically forms an angle in the range of 30 degrees to 90 degrees. The apex 35 and front surfaces 36 of the die tip 3 may be coated with a heat-insulating material or layer. If desired, the coating may also be applied to all the air intake passages 34.

The most radially outward portions of the die tip 3 are end brackets 37, which provide a location for attachment of the air plates 4. The air plate 4 is positioned in area defined by the surface of the end bracket 37, the downstream surface 36 of the die tip body 3, and the surface of the apex 35 of the die tip 3. Each air plate 4 is secured to the downstream surface 36 of the die tip 3 by a removable fastener 41, such as a screw. When the fastener 41 is loosed, the other fasteners—for instance, push screws 38 and pull screws 39—may be turned to push or pull the air plate 4 until the air gap 40 is set to the desired position and is symmetrical with the opposing air plate 4 in the cross direction. Then, the fastener 41 is tightened to secure the air plate 4 to the die tip 3.

The size of the air gap 40 and the pressure of the supplied air together determine the flow rate and the air speed of the air knives. Optionally, the geometry of the air knife may be further defined by the distance between the outlets 33 of the apex 35 and the downstream surface of air plates 4, which is known in the industry as the "set-back" distance (designated "T" in FIG. 3).

Advantageously and in contrast to conventional melt blowing die tips, the air gap-setting task may be performed whether or not the die tip 3 is mounted on the die body 2. Clearly, this ability to set the air gap without removing the die tip 3 provides significant operational convenience. Preferably, the air gap-setting task is performed when the die tip assembly 7 is at or near the normal operating temperature to avoid skew that may be caused by thermal expansion. To achieve the desired set-back distance "T", shim stocks of appropriate thickness may be used, the installation of which may be accomplished on- or off-line.

FIGS. 4 through 7 show various views of the air plate 4. The air plate 4, when installed and in combination with the die body 3, defines an air flow distribution chamber 42. The term "air flow distribution chamber" refers to a gap formed between the front (or downstream) surface 36 of the die tip 3 and the back (or upstream) surface of the air plate 4. The air flow distribution chamber 42 is created by recesses formed on the back surface of the air plate 4. Alternately, the front surface 36 of the die tip 3 may be carved to form the air flow distribution chamber 42.

The air flow distribution chamber 42 includes multiple sub-chambers 44 and a common tranquilizing chamber 45, which are designed to smoothly recombine into a uniform slit flow the multiple incoming air flows from the air intake passages 34 that are fed by the primary air tubes 9. According to one embodiment, for each half of the melt blowing apparatus, the number of sub-chambers 44 per air plate 4 is equal to the number of primary air tubes 9 on the given half of the apparatus 1, such that each sub-chamber 44 receives an equivalent air flow. The use of multiple sub-chambers 44 feeding a single tranquilizing chamber 45 to produce a uniform flow is scalable to melt blowing apparatuses of any width from narrow to wide. Furthermore, the total air flow volume may be conveniently increased as needed to produce a wider apparatus (in CD), without the need to proportionally increase the height (HT) and length (in MD) of the apparatus, thus representing a significant improvement over conventional devices where an increase in one dimension necessitates an increase in all dimensions.

Each sub-chamber 44 is a gentle radial expansion of the flow pathway, and all of the sub-chambers 44 are of an equal size and shape. The sub-chambers 44 diverge seamlessly into the tranquilizing chamber 45, which is a straight passage designed to reduce turbulence in the air flow.

FIGS. 4, 5, and 6 show the relative shape and dimensions of an exemplary air plate 4 with letters A through N, as set forth in TABLE 2 of the EXAMPLE. The flow distribution chamber 42 is as wide as the gap 40 (width "A") and has a depth identified as "L" (FIG. 5).

Figure 7:
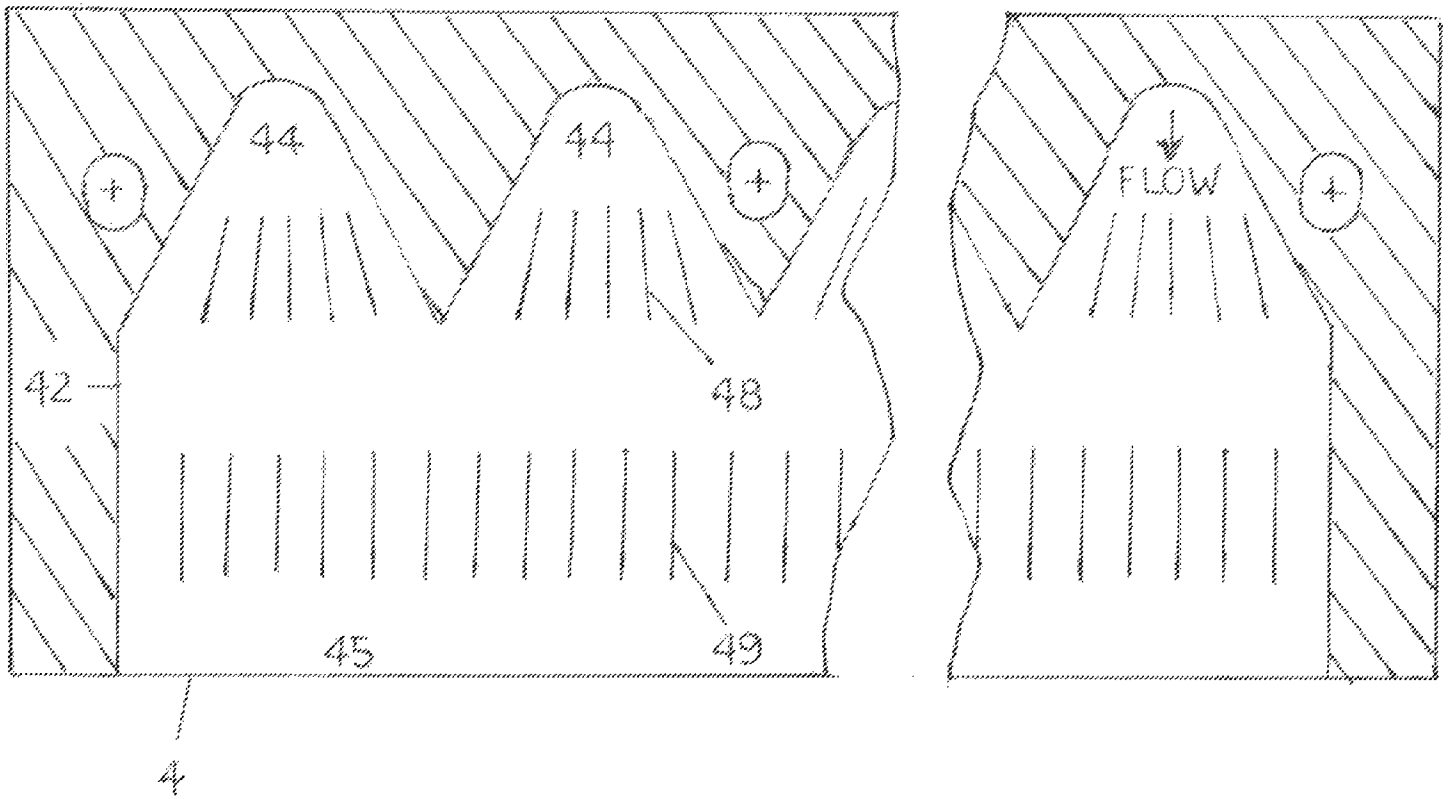
FIG. 7 is a plan view of the air plate of FIG. 4, illustrating two types of flow regulating vanes.

In another aspect of the present disclosure and with reference to FIG. 7, the air flow distribution chamber 42 may be made more effective at producing a uniform slit flow by providing regulating vanes 48, 49 to the sub-chambers 44 and the tranquilizing chamber 45, respectively. The regulating vanes 48 are radially oriented to spread the flows in the sub-chambers 44, while the regulating vanes 49 are axially oriented to help subdue flow turbulence and side currents in the tranquilizing chamber 45. In practice, it has been found that the chambers 44, 45 are often effective enough in producing a uniform slit flow that the regulating vanes 48, 49 are unnecessary.

While the embodiment shown in FIG. 2 illustrates the primary air tubes 9 supplying air through air intake passages 34 in the die tip 3, it should be understood that the primary air tubes 9 may instead be positioned to direct the air directly into the front (downstream) surface of the air plates 4 with the same results as described herein.

Figure 8:
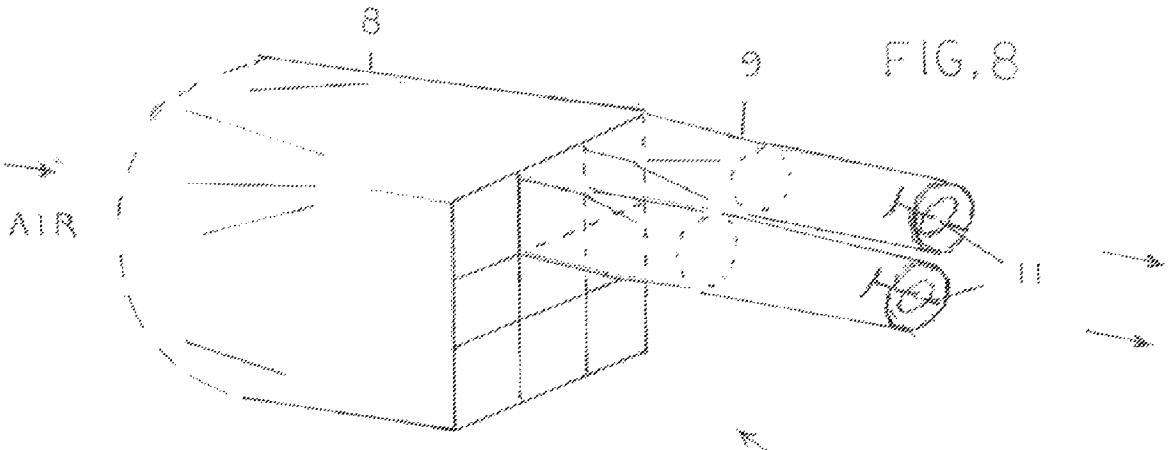
FIG. 8 is a perspective view of a flow-splitting device for dividing a single pipe flow into multiple equal flows with low pressure loss, according to the present disclosure.
Figure 9:
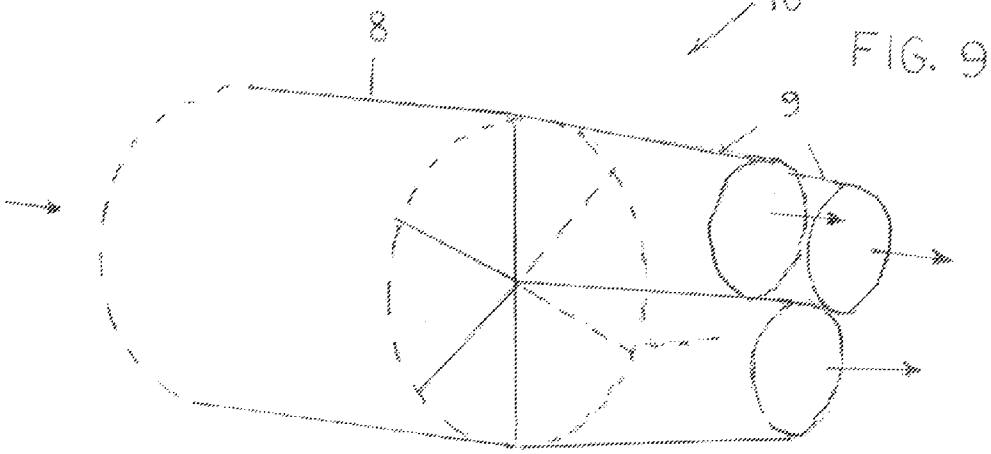
FIG. 9 is a perspective view of another flow-splitting device, as an alternate to the device in FIG. 8.

According to another aspect of the present disclosure, FIGS. 8 and 9 illustrate two equally effective flow splitting devices 10 for splitting the primary air flow from a single primary air conduit 8 into multiple primary air tubes 9. As shown in FIG. 8, the flow splitting device 10 directs the primary air conduit 8 into a square cross-sectional panel having a grid of equally sized extensions that direct the flow to each of the primary air tubes 9. FIG. 9 shows an alternate flow-splitting device 10, in which the primary air conduit 8 is split into equally sized radial sections. The flow-splitting device 10 includes extensions from each radial section to one of the primary air tubes 9. The same result may be achieved with triangular or hexagonal shaped splitters.

Unlike the conventional primary air flow pathways, such as those shown in FIG. 1, the flow-splitting devices 10 described herein cause little pressure loss to the flow, because both the flow area and direction of the primary air flow are essentially unchanged before and after the flow splitting device 10. If desired, each primary air tube 10 may be provided with an adjustable damper, or valve, 11 to assure that the air flows among the individual air tubes 9 are equal. The fine tuning of the dampers 11 may be done at equipment set-up and typically does not require additional adjustment.

Figure 10:
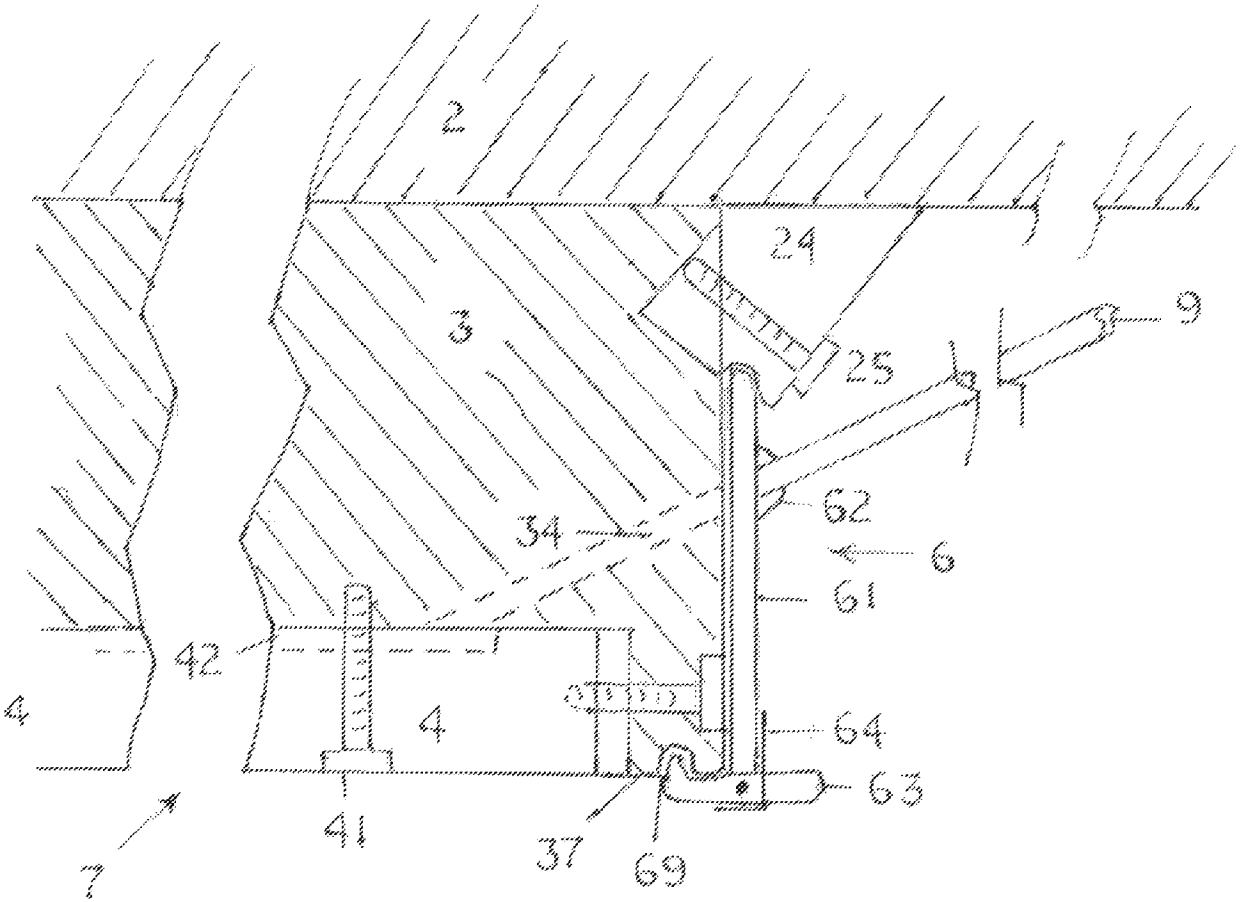
FIG. 10 is a side cross-sectional view of a device for quick connection of the primary air tubes, according to the present disclosure.

The primary air tubes 9 are generally of equal size and length and are preferably neatly bundled together. According to another aspect of the present disclosure, FIG. 10 shows a tube organizer device 6. The organizer device 6 includes a bar 61 defining apertures therethrough, the primary air tubes 9 being positioned through the apertures in a single row. One or more bars 61 may be used to house the primary air tubes 9 for the melt blowing apparatus 1. A tube holder 62 holds each primary air tube within the apertures in the bar 61.

The organizer device 6 is mounted to the die tip assembly 7, such that the primary air tubes 9 may be easily connected or disconnected from the die tip assembly 7 for use or maintenance, respectively. Conveniently, the organizer device 6 and the primary air tubes 9 are detachable from the apparatus as a unit. The upstream end of the bar 61 is secured in a hinge socket 26 defined in the steel bars 24 supporting the die tip assembly 7. The distal (downstream) end of the bar 61 is provided with a locking handle 63 and a handle spring 64. The locking handle 63 pivots about the distal end of the bar 61 to engage a slot 69 in the end bracket portion 37 of the die tip assembly 7, where the handle 63 is held in position by the handle spring 64. The organizer device 6 saves labor and time during a die tip assembly 7 changeover, by permitting all of the primary air tubes 9 to be moved or removed in unison.

Figure 11:
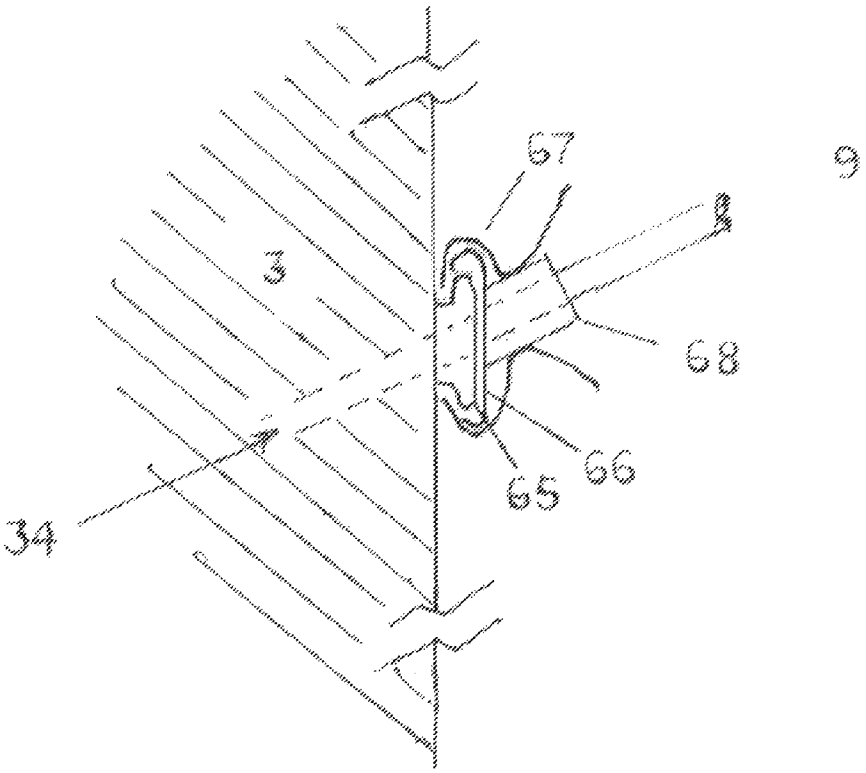
FIG. 11 is a side cross-sectional view of a device for quick connection of the primary air tubes, as an alternate to the device in FIG. 10.

An alternate device for quickly connecting and disconnecting the primary air tubes 9 to the die tip 3 is provided in FIG. 11. In this arrangement, a linear guide bar 68 has apertures therethrough for receiving each of the primary air tubes 9 and terminates in a spring plate 66. An anchor 65 is mounted on the periphery of the die tip 3 and provides a contact surface for the spring plate 66. A locking device 67 is based on the spring plate 66 with one end held in a groove between the anchor 65 and the die body 3 and the opposite end unencumbered to function as a handle. When the handle end of the locking device 67 is pressed down (that is, toward the guide bar 68), the locking device 67 is disengaged from the anchor 65, and the guide bar 68 housing the tubes 9 is ready for removal from the die tip 3.

The locking device 67 functions similarly to a spring-loaded paper clip. However, this locking device 67 is provided by way of example only and should not be construed as limiting the invention. Those of ordinary skill in the art may identify other mechanisms for providing quick connection and disconnection of the tube bundle. These mechanisms, as well as modifications or variations of the particular locking device 67 described herein, are intended to fall within the spirit and scope of the present disclosure.

The present inventive apparatus yields many significant advantages, some of which are qualitative and some of which are quantitative. Among the advantages of the present melt blowing apparatus are:

1. The air knives, as disclosed herein, are more uniform than those achievable by the conventional art. Moreover, the equipment required is simpler than the conventional art, including structures taught in U.S. Pat. No. 4,818,463; U.S. Pat. No. 5,080,569; U.S. Pat. No. 5,248,247; U.S. Pat. No. 5,580,581; and U.S. Patent Application Publication No. 2002/0053390 A1.

2. The air flow paths for the primary air are simplified and streamlined, thus reducing energy consumption.

3. The thermal interference between the polymer melt flow and the primary air flow is greatly reduced, thereby enabling the use of much cooler secondary air flow. As a result, energy is saved, and many heat-related process problems are minimized or resolved.

4. The present melt-blowing apparatus has a smaller machine direction dimension than is achievable with conventional melt-blowing equipment. While conventional equipment has a machine direction width of between 1.5 meters and 5 meters, the present apparatus may have a machine direction width of around or slightly less than 0.5 meters.

5. The present melt-blowing apparatus facilitates wide widths with excellent air knife uniformity, without having to enlarge the machine direction and height dimensions. Thus, the present melt-blowing apparatus saves cost and space.

6. The present melt-blowing apparatus is able to increase the primary air flow volume more conveniently to enable a higher production rate, as well as the production of finer fibers. Both capabilities lead to greater profit for the nonwovens manufacturer.

7. Because a cooler air (or gas) knife is denser than a hot air knife, the cooler air knife is better able to attenuate and quench the fibers. For example, air at 160° F. is 39% heavier than air at 400° F., so the cooler air better attenuates and cools the fibers.

8. Scheduled and unscheduled downtime may be significantly reduced, because a die tip replacement no longer requires lengthy cooling-off and reheating steps.

Methods for estimating quantitative savings are illustrated in the following sections.

EXAMPLE

A full size model of the primary air delivery system, according to the present disclosure, was built and tested to determine the effectiveness and advantages of the resulting air knife. For the purpose of testing, only one side of the two symmetrical mirror images was produced. The full width (CD) of the model was 10 inches. The width of the air knife was 9 inches. The die tip had a 60-degree angle at its apex. The air gap formed by the air plate and the die tip was 0.060 inches.

Figure 12:
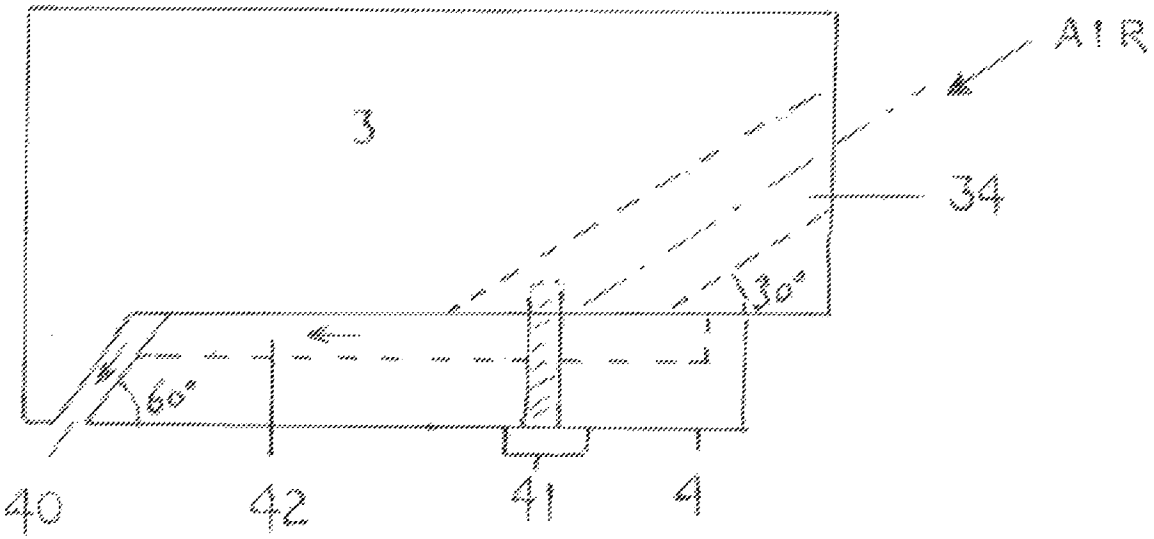
FIG. 12 is a cross-sectional view of a full-size test model of the primary air delivery system, according to the present disclosure.

The model's configuration differs from that of a conventional counterpart in only two ways: (1) six tunnels were drilled on the side of the die tip for receiving air from six external tubes, as shown in FIGS. 3, 10, and 12; and (2) an air distribution chamber (42) was carved on the inner (upper) surface of the air plate 4, as shown in FIGS. 4, 5, and 6. Each of the six air tubes had an inner diameter of 0.375 inches.

Referring to FIGS. 4, 5, and 6, the dimensions used in the Example embodiment are shown in TABLE 2.

TABLE 2

Exemplary Air Plate Dimensions

| ID | Description | Dimension |
|---|---|---|
| A | Axial width of the air gap (also the width of the resulting nonwoven mat) | 9 inches |
| B | Radial length of the air plate (longest in machine direction) | 3.125 inches |
| C | Width of end portion of the air plate | 0.5 inches |
| D | Thickness of the air plate | 0.5 inches |
| E | Full width of air flow distribution sub-chamber 44 | 1.5 inches |
| F | Center of elongated through-hole for fastener 41 | 0.875 inches |
| G | Location where tranquilizing chamber 45 begins | 0.625 inches |
| H | Length of elongated through-hole for fastener 41 | 0.40625 inches |
| I | Distance between uppermost area of air flow distribution sub-chamber 44 and the proximate edge of the air plate 4 | 0.25 inches |
| J | Center of an imaginary partial circle whose radius defines the sub-chambers 44 of the air flow distribution chamber | 0.5 inches |
| K | Diameter of a through-hole for fastener 41 | 0.28125 inches |
| L | Depth of air flow distribution sub-chamber 44 and tranquilizing chamber 45 | 0.1875 inches |
| M | Radius of an imaginary partial circle with center J, which defines the sub-chambers 44 of the air flow distribution chamber | 0.25 inches |
| N | Angle at tip of the air plate 4 (equal to apex angle of die tip 3) | 60 degrees |

Such dimensions were chosen for exemplary purposes and in no way are meant to be construed as limiting the present apparatus to any particular size or dimension. The example assembly is both sufficiently realistic and of practical size that it would be suitable for normal and routine production for melt blown nonwoven substrates and would achieve the previously mentioned benefits.

In this example, air is used as the primary air flow medium. It should be understood that other gases (including inert gases) used instead of, or in addition to, air are intended to fall within the scope of the present disclosure.

As shown in FIG. 4, the air chamber (42) had six sub-chambers (44). They were evenly spaced across the air knife's working width of 9 inches and shared a common downstream tranquilizing chamber (45).

In the test, the primary air flow was pressurized but unheated. Air pressure supplied was 4 psig. A pressure gauge measured air pressure.

A Pitot tube and manometer measured air speed. During the test, there was no air speed difference measured across the entire width of 9 inches. The air knife's speed at the air gap was 26,000 feet per minute (430 feet per second, 3 inches Hg column, or 0.38 Mach). The total air volume was calculated to be 98 cubic feet per minute (11 cubic feet per minute per inch of air knife's width, or 16 cubic feet per minute per air tube). Such air speed and volume are typical in the production of melt blown nonwovens.

Energy Impact

Performance information on conventional air knives may be obtained from patents, publications, and industrial experience, as follows:

An air knife's speed commonly ranges from about 400 feet per second to about 500 feet per second. A cross-direction uniformity of plus or minus 5% (±5%) is considered usable on narrow melt-blowing apparatuses (up to 1 meter or 40 inches wide). There has been no report on air uniformity requirements or speed for melt blowing equipment wider than 1 meter. As has been discussed previously, air uniformity is known to critically impact product uniformity, material efficiency and profit.

The temperature of the primary air flow commonly ranges from about 300° F. to about 700° F. The selected temperature depends on the polymer type, the desired fiber diameter, and also the production rate. For some polymers having a very high melting point, the primary air flow temperatures may be higher than 800° F.

The pressure of the primary air flow supplied to conventional melt blowing apparatuses, such as the exemplary device 100 shown in FIG. 1, ranges from about 10 psig to about 30 psig and, more commonly, from about 12 psig to about 15 psig. It is understood that a large pressure loss tends to yield better flow uniformity. Depending on the design of the manifolds and/or the desire for greater air knife uniformity, higher air pressures may be used. For some applications where the final nonwoven substrate is used for low-grade products, such as oil sorbents and shop wipes, air pressures of lower than 10 psig may be feasible.

The steps of heating and pressurizing the primary air flow consume roughly equal amounts of energy. Together, these steps account for 70% to 80% of the total energy used in production of the nonwoven web.

A conventional die tip may be expected to work for 10 to 15 straight shifts before contaminate builds up in the orifices and the die tip requires replacement. A typical die tip replacement takes from 5 to 8 hours, largely because of the slow cool down of the machine involved. Cooling down is much more time-consuming than heating up.

The typical pressure drop for the primary air flow to go through an electric heater is about 0.5 psig.

Based on this information, it is possible to estimate the energy savings and downtime reduction that are achievable with the present invention. To start, when the pressure of the primary air supply is reduced from 12 psig to 4 psig, the cost of pressurizing the air is cut by 66.7%, and the total energy consumption is reduced by 25.0% (37.5%×66.7%).

As the air exits the blower, it is warmed to a temperature of about 150° F. In the present melt-blowing apparatus, the requisite air temperature may be as low as 200° F., as compared with a conventional melt-blowing apparatus that uses air temperatures of about 350°, which are comparable to the polymer melt temperature. The energy savings from the reduced air heating requirement may be estimated in the following manner: The thermal content of air is 21.9 Btu/lb. at 150° F., 34.0 at 200° F., 70.7 at 350° F. Thus, the Btu required to heat each pound of air from 150° F. to 200° F. is 12.1 Btu, while conventional systems that heat the air from 150° F. to 350° F. require 48.8 Btu. The air heating energy, therefore, may be reduced by 75.2% (12.1 Btu versus 48.8 Btu) through the teachings of the present disclosure. The total energy consumption is reduced by 28.2% (37.5%×75.2%).

The combined savings from the air pressure reduction and the air temperature reduction are therefore 53.2% (25.0%+28.2%) of the total energy use realized with the prior art equipment.

In addition to energy savings, the present disclosure provides a melt blowing apparatus with faster and simpler replacement of the die tip assembly, leading to shorter downtimes. Specifically, the time for replacing the die tip assembly of the present apparatus is only one hour. In contrast, with conventional devices, the die tip assembly requires a long cool-down period before removal, a long replacement period, and a long reheating period (collectively, about five hours). By reducing the die tip assembly replacement time from five hours to one hour, the machine downtime is reduced by 80%.

Many other benefits to process and product quality (such as those described above) cannot be quantified so simply, but also are highly valuable nevertheless.

The preceding discussion merely illustrates the principles of the present melt blowing apparatus and its primary air supply system. It will be appreciated that those skilled in the art may be able to devise various arrangements, which, although not explicitly described or shown herein, embody the principles of the inventions and are included within their spirit and scope. Furthermore, all examples and conditional language recited herein are principally and expressly intended to be for educational purposes and to aid the reader in understanding the principles of the inventions and the concepts contributed by the inventor to furthering the art and are to be construed as being without limitation to such specifically recited examples and conditions.

Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure. Terms such as "axially", "radially", "upstream", and "downstream" are intended only to aid in the reader's understanding of the drawings and are not to be construed as limiting the invention being described to any particular orientation or configuration, unless recited in the claims.

This description of the exemplary embodiments is intended to be read in connection with the figures of the accompanying drawings, which are to be considered part of the entire description of the invention. The foregoing description provides a teaching of the subject matter of the appended claims, including the best mode known at the time of filing, but is in no way intended to preclude foreseeable variations contemplated by those of skill in the art.

What is claimed is:

1. An apparatus for forming a melt blown nonwoven substrate, the apparatus comprising:

a die body for receiving a molten polymer stream from an extruder, the die body defining a channel therethrough;

a die tip assembly downstream of the die body, the die tip assembly comprising a die tip having a die tip apex in fluid communication with the channel in the die body and further having air intake passages defined therethough; the die tip assembly further comprising a pair of oppositely disposed air plates located radially outward of the die tip apex and axially downstream of the die tip to define a first gap and a second gap between the die tip and the air plates; wherein the first gap between the die tip and the air plates is perpendicular to the channel and comprises an air flow distribution chamber having multiple sub-chambers, the multiple sub-chambers expanding into a tranquilizing chamber;

a plurality of primary air tubes arranged in oppositely disposed sets, each set located radially outward of and separated from the die body, each of the primary air tubes being configured to convey a pressurized gas stream through the air intake passages of the die tip, through the first gap, and further into the second gap adjacent the air plates to produce gas knives; and a collector surface disposed opposite the die tip apex at a die-to-collector distance, such that the molten polymer stream passing through the die tip apex is attenuated by the gas knives to form melt blown filaments that fall as fibers on the collector surface to produce the melt blown nonwoven substrate.

2. The apparatus of claim 1, wherein the polymer is one of: a homopolymer, a block copolymer, a graft copolymer, a random copolymer, an alternating copolymer, a terpolymer, blends, and modifications thereof.

3. The apparatus of claim 1, further comprising mounting brackets configured to secure the air plates to the die tip assembly.

4. The apparatus of claim 1, wherein the air plates are positioned symmetrically about the die tip apex.

5. The apparatus of claim 1, wherein the pressurized gas stream is heated air.

6. The apparatus of claim 1, further comprising a flow-splitting device upstream of the plurality of air tubes, the flow-splitting device dividing the pressurized gas stream into a plurality of pressurized gas streams with no to minimal change in flow direction.

7. The apparatus of claim 6, further comprising a flow damper on at least one of the plurality of air tubes, the flow damper being located between the flow-splitting device and one of the respective air intake passages.

8. The apparatus of claim 1, further comprising an organizer device comprising a bar defining apertures therethrough, at least a portion of the plurality of air tubes being positioned through the apertures, the organizer device further comprising a lock handle and a handle spring such that the organizer device and the air tubes are detachable as a unit from the die body.

9. The apparatus of claim 1, wherein the melt blown filaments have an average diameter in the range of 0.2 microns to 100 microns.

10. The apparatus of claim 1, wherein surfaces of one or more of the air intake passages, the die tip, and the air plates contacted by the primary gas are coated with a thermal insulating material.

* * * * *